United States Patent [19]

Eskelinen

[11] Patent Number: 4,551,203

[45] Date of Patent: Nov. 5, 1985

[54] METHOD AND ARRANGEMENT FOR GUIDING A PAPER WEB FROM THE PRESS SECTION TO THE DRYING SECTION

[75] Inventor: Pekka Eskelinen, Turku, Finland

[73] Assignee: Valmet Oy, Finland

[21] Appl. No.: 595,969

[22] Filed: Apr. 2, 1984

[51] Int. Cl.[4] ..... D21F 11/00; D21F 3/00; D21F 5/00

[52] U.S. Cl. ..... 162/202; 162/207; 162/305; 162/306; 162/290; 34/114; 34/116

[58] Field of Search ..... 162/306, 307, 305, 359, 162/360.1, 202, 207, 290; 34/114, 116, 156

[56] References Cited

U.S. PATENT DOCUMENTS

| | | | |
|---|---|---|---|
| 3,367,035 | 2/1968 | Tomlinson | 34/156 |
| 3,861,996 | 1/1975 | Dorfel | 162/306 |
| 3,874,997 | 4/1975 | Kankaanpaa | 34/116 |
| 3,979,038 | 9/1976 | Karlsson | 34/156 |
| 4,016,032 | 4/1977 | Kankaapaa | 162/305 |
| 4,194,947 | 3/1980 | Huostila et al. | 162/306 |
| 4,247,993 | 2/1981 | Lindstrom | 34/156 |
| 4,359,828 | 11/1982 | Thomas | 34/116 |
| 4,414,757 | 11/1983 | Whipple | 34/156 |
| 4,440,598 | 4/1984 | Koski et al. | 162/360.1 |

*Primary Examiner*—S. Leon Bashore
*Assistant Examiner*—K. M. Hastings
*Attorney, Agent, or Firm*—Steinberg & Raskin

[57] ABSTRACT

Apparatus and method for guiding a fibrous web from a press section to a drying section, such as guiding a paper web from the press section to the drying section in a paper-making machine. The apparatus comprises a fetching roll adapted to guide the web passing from the press section onto a drying wire from the drying section passing about the fetching roll, and means for urging the web and drying wire against one another as the web is passed to the drying section, this urging means disposed between the fetching roll and the drying section in a running direction of the web and wire. The method of the present invention comprises passing the web from the press section onto a drying wire passing about a fetching roll, and urging the web and drying wire against each other as the drying wire passes from the fetching roll to the drying section.

18 Claims, 2 Drawing Figures

METHOD AND ARRANGEMENT FOR GUIDING A PAPER WEB FROM THE PRESS SECTION TO THE DRYING SECTION

BACKGROUND OF THE INVENTION

The present invention is directed to an apparatus and a method for guiding a fibrous web from a press section to a drying section, such as guiding a paper web from the press section of a paper machine to the drying section thereof. More particularly, the present invention is directed to such an apparatus and method for guiding a fibrous web from a press section to a drying section, in which the web is guided and supported on a drying wire as the web is guided into the drying section, such as around an initial group of drying cylinders.

After pressing, a fibrous web such as a paper web prepared in a paper machine, is extremely weak. A large number of breaks in the web tend to occur in the run thereof between the press section and a first drying cylinder within a drying section. Other dubious points in this regard where such breaks in a paper web tend to occur, include, e.g., spaces between individual drying sections or between individual groups of drying cylinders, or spaces occuring between successive sections in a paper-making machine. In other words, a web is prone to breaking or tearing at all locations where the web itself runs unsupported, i.e. in a free or open draw.

Moreover, since the last roll in a press section is usually a stone roll, it is difficult to detach a running web from this roll because the web will tend to follow the very smooth face of the stone roll.

The known "SYM-PRESS" press section, which can be applied in accordance with the apparatus and method of the present invention, comprises a closed roll combination having four press rolls, in which the first nip is formed between a hollow-faced roll and a suction roll, and is provided with two pressing felts. The second single-felt nip of the "SYM-PRESS" press section is formed between the suction roll and a center roll of the press section. The center roll of the "SYM-PRESS" press section is a smooth-faced stone roll, the third, final nip of the press section being formed in connection with this stone roll and being provided with its own felt. The running fibrous web is detached from the smooth face of the stone roll in the "SYM-PRESS" press section by extending or stretching the web in the running direction.

The running web had to be extended extensively in the prior art, by up to two to three percent in the running direction thereof, in order to detach the web from the stone roll. Such extensive stretching or extending was necessary so that it would be possible to control fluttering of the running web that would occur between the press section and the drying section. However, a paper-making machine should be run with minimum differences in speeds of the running webs, so that the web itself should not lose any of its strength. Additionally, the great degree of extending resulted in many later disadvantages and difficulties, such as in connection with coating of the fibrous web or paper so prepared.

A prior art publication by Scapa-Porrit Ltd., entitled "Felts and Fabrics. Sheet Flutter in the Dryer Part", suggests a method for detaching the web from the stone roll by means of a suction roll, in which the web is passed and supported all the way from the press section onto a first drying cylinder in a drying section. However, the running web is detrimentally extended in the method suggested in this publication.

Moreover, this particular prior art method disclosed in the Scapa-Porrit Ltd. publication, has proven much more difficult to apply in practice, then previously expected. Suction alone is not sufficient for detaching a fibrous web from a stone roll. Moreover, it has been found that the web will not remain in contact with the drying wire without additional support, and a closing nip formed by a first drying cylinder in the drying section with the drying wire, causes wrinkles in the web, in particular along the sides of the running web. If a felt is used instead of a drying wire, then problems such as rewetting of the running fibrous web as well as contamination of the suction rolls, have been encountered.

Attempts have recently been made in the case of paper machines, to reduce the overall number of suction rolls, and even aim at entirely eliminating the need for any suction rolls, since such suction rolls are costly, require a tremendous amount of energy and maintenance, and easily malfunction or break down. Threading of the end of the fibrous web is also difficult when a suction roll is used for detaching the web from a stone roll, since during the threading of the web, the suction roll also inspires ambient air from surrounding areas not covered by the web, so that no suctioning effect is generated on the tail end of the web.

SUMMARY OF THE INVENTION

Accordingly, it is an object of the present invention to provide a new and improved apparatus and method for guiding a fibrous web such as a paper web from a press section to a drying section, in which such a web can be smoothly, securely guided in the run from the press section to the drying section.

It is also an object of the present invention to provide a new and improved method and apparatus for guiding a fibrous web from a press section to a drying section, which eliminates any detrimental fluttering of the web as it passes from the press section to the drying section.

It is another object of the present invention to provide a new and improved apparatus and method for guiding a fibrous web from a press section to a drying section, in which extension or streching of the web in the running direction thereof can be significantly reduced.

It is a further object of the present invention to provide a new and improved apparatus and method for guiding a fibrous web such as a paper web from a press section to a drying section, such as in a paper-making machine, in which the chance of any breaks or tears occuring in the running web from the press section to the drying section, can be substantially reduced.

It is a further object of the present invention to provide a new and improved apparatus and method for guiding a running fibrous web from a press section to a drying section, in which detachment of the web from the press section, such as from a stone roll in the press section, can be facilitated and enhanced.

It is still another object of the present invention to provide a new and improved apparatus and method for guiding a fibrous web from a press section to a drying section, in which differences in running speed of the web can be minimized.

It is a still further object of the present invention to provide an apparatus and method for guiding a fibrous web from a press section to a drying section, in which deterioration of the strength of the running web can be minimized.

It is even a further object of the present invention to provide a new and improved apparatus and method for guiding a fibrous web from a press section to a drying section, in which such web is suitably guided on a running support such as on a drying wire of the drying section.

It is even another object of the present invention to provide a new and improved apparatus and method for guiding a fibrous web from a press section to a drying section, in which such guidance and detachment of the web from the press section by way of suction, can be enhanced.

These and other objects are attained by the present invention, which provides an apparatus for guiding a fibrous web, such as a paper web, from a press section to a drying section, which comprises a guide or fetching roll adapted to guide the web passing from the press section onto a drying wire from the drying section that passes about the fetching roll, and means for urging the web and drying wire against one another as the web is passed to the drying section, said urging means disposed between said fetching roll and the drying section in a running direction of the web and drying wire.

The fetching roll constitutes means for passing the web in an open or free draw from the press section onto the drying wire, and the urging means also comprises means for generating a negative pressure in a space adjacent a side of the drying fabric opposite the side contacting the running web, to urge the web and drying wire against one another.

The fetching roll may be a suction roll having a suction zone over which the drying wire passes, and the negative pressure generating means may comprise at least one blowing box having a nozzle slot extending substantially over an entire width of the web, this blowing box adapted to direct a gas stream through the nozzle slot in a direction substantially parallel to the running direction of the web and drying wire and at a speed greater than a running speed of the drying wire, to thus create negative pressure between the blowing box and the drying wire, to thereby urge the web and drying wire against one another. The drying wire may then pass, carrying the web, over a first drying cylinder group in the drying section of a paper machine. Moreover, the negative pressure generating means may comprise three blowing boxes successively disposed in the running direction of the drying wire and web, with sides of the boxes facing the drying wire being disposed in substantially the same plane (the sides of the blowing boxes may be disposed substantially parallel to this particular run of the drying wire and fibrous web).

The present invention is also directed to a method for guiding a fibrous web, such as a paper web, from a press section to a drying section, such as in a paper making machine, which comprises the steps of passing the web from the press section onto a drying wire passing about a guide or fetching roll, and urging the web and drying wire against each other as the drying wire passes from the fetching roll to the drying section (for example, about a first group of cylinders in the drying section).

The web is passed in an open draw from the press section onto the drying wire, while the web and drying wire may be urged against each other by ejecting air out of a space on a side of the drying wire opposite the side supporting the running web. The air may be ejected out of this space by blowing gas in a direction substantially parallel to a running direction of the drying wire and web, and at a speed greater than a running speed of the drying wire.

The fetching roll may be disposed as close as possible to the press section, such as, as close as possible to a smooth-faced center roll of a closed press section from which the web is detached. Additionally, the gas may be blown through several distinct jet steams, with the initial direction of such streams extending substantially parallel to the running direction of the drying wire between the fetching roll and the subsequent drying section. Thus air can be successfully ejected out of the space on the side of the drying wire opposite the side supporting the running fibrous web.

BRIEF DESCRIPTION OF THE DRAWINGS

The objects noted above, along with other objects, will become readily apparent by the following description of the present invention in detail, with reference to the enclosed drawings (the present invention not being restricted to the details of the enclosed drawings), in which.

DETAILED DESCRIPTION OF PREFERRED EMBODIMENTS

Figure 1:
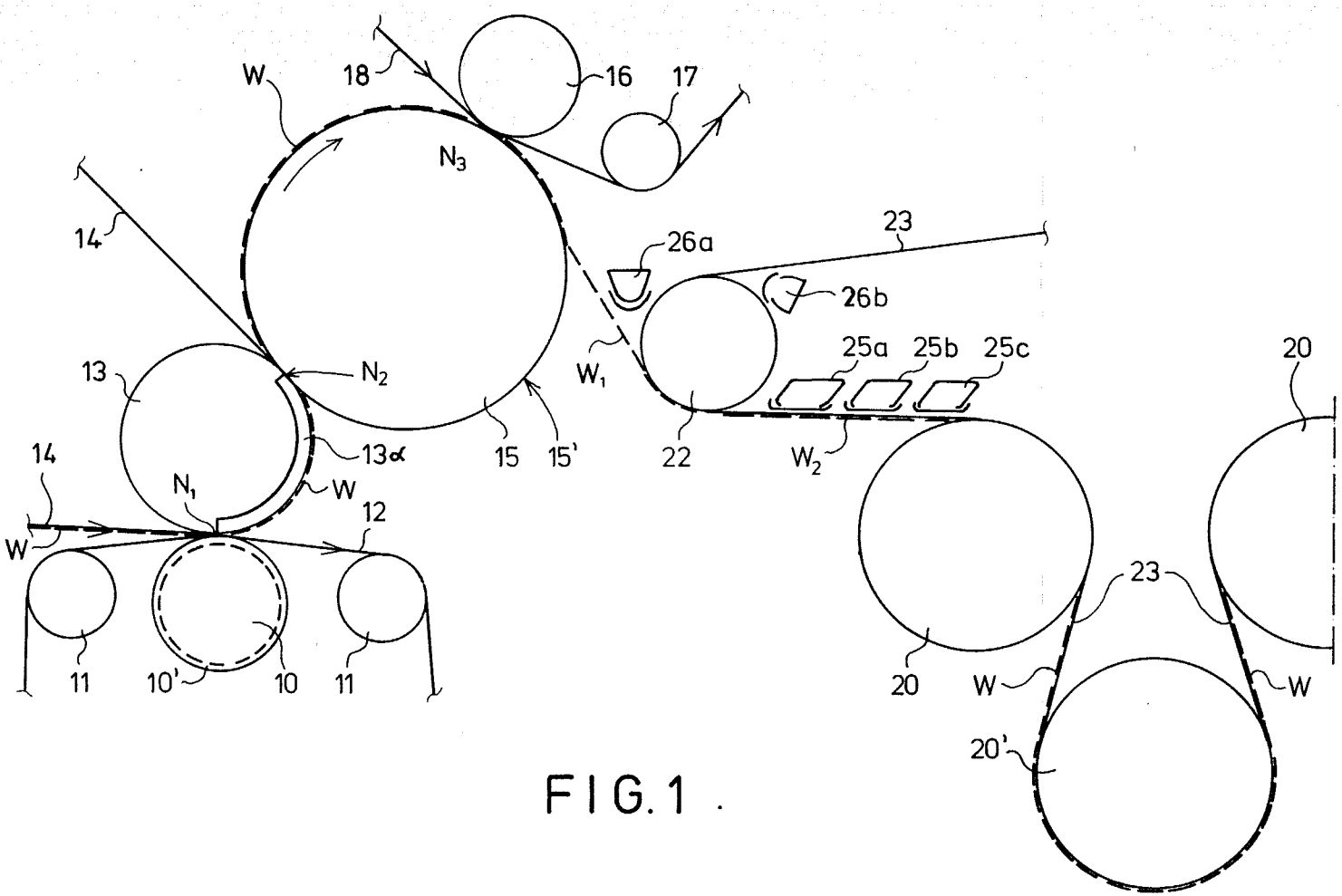
FIG. 1 is a schematic representation illustrating the running of a fibrous web through a "SYM-PRESS" press section and the supporting of such a run of the web, as well as the guiding of the run of the web to an initial end of the subsequent drying section, in accordance with the present invention.

Referring to FIG. 1, initially an example of a press section in a paper making machine will be described, with which the apparatus and method of the present invention can be advantageously applied. However, the present invention is not restricted to being solely used only in connection with the particular press and drying sections illustrated in FIG. 1, but may be used with any suitable kind of press and/or drying sections for a fibrous web.

Referring to FIG. 1, the paper web W arrives in the press section on the fabric 14. The fabric 14 may be, for example, a pick-up fabric, with the web W being transferred from the forming wire by a pick-up roll (not illustrated) onto the fabric 14. The fabric 14 runs through the first nip $N_1$ in the press section. The first nip $N_1$ is formed between a lower roll 10 having a hollow face 10', and a suction roll 13 provided with a suction zone 13a. The first nip $N_1$ is a two-felt nip, with a lower felt fabric 12 running as guided by guide rolls 11, as illustrated in FIG. 1. The other felt in the first nip $N_1$ is the felt 14, which also acts as a press fabric in the second nip $N_2$.

After the first nip $N_1$ in the press section, the web W passes about suction roll 13 as guided by the felt 14, and into the second nip $N_2$ which is formed between the suction roll 13 and a center roll 15 having a smooth face 15'. After the second nip $N_2$, the web W is separated from the felt 14 by adhering to the smooth face 15' of the center roll 15 in the press section. This center roll 15 is usually a stone roll, with a diameter advantageously greater than the diameters of any of the other press rolls in the press section. The third nip $N_3$ is formed between the center roll 15 and a press roll 16 as illustrated in FIG. 1, with the web W passing about the smooth face 15' of the center roll 15 and into this third nip $N_3$. A press felt 18, guided by guide roll 17, passes through this third nip $N_3$ in the press section, as illustrated in FIG. 1.

Then, after passing through this third nip $N_3$ of the press section, this running section $W_1$ of the web W is detached from the smooth face 15' of the stone roll 15, and supported in accordance with the present invention, which principly comprises a fetching roll 22 with a drying wire 23 of a subsequent drying section running over the same, and blowing boxes **25*a*, 25*b*, and 25*c*. FIG. 1 also illustrates the incoming end of the subsequent drying section, in other words the cylinders 20 of an upper row and the cylinder 20' of the lower roll, with the web W being supported by the drying wire 23** on the various runs between these cylinders as illustrated.

As noted above, the web W tends to remain in contact with the smooth face 15' of the stone roll 15, due to adhesive force. The web W is detached from the stone roll 15 by extending the web W, i.e. stretching the web in the running direction thereof. The fetching roll 22 has been disposed extremely close to the stone roll 15, so that any fluttering of the web W on its open or free run $W_1$ will hardly take place. Therefore, a stretching or extension of only about 1 to 1.5% in the running direction of the web W, is sufficient for detaching the web W from the smooth face 15' of the stone roll 15. The web W is disposed against the drying wire 23 that passes around fetching roll 22, after which the web W is passed, as supported on the wire 23 along section $W_2$ thereof, onto the first drying cylinder 20 or onto a corresponding lead-in cylinder of the drying section.

Between the fetching roll 22 and the first drying cylinder 20, the section of the running web $W_2$ is supported on the drying wire 23 in accordance with the present invention. Air jets $S_1$ are blown out of the respective blowing boxes **25*a*, 25*b*, and 25*c* disposed along the run of the drying wire 23 after the fetching roll 22 and before the drying section, on the side of the wire 23 opposite the side contacting and supporting the running web $W_2$. The air jets $S_1$ are blown substantially in the direction of running of the wire 23, with the speed of the air jets $S_1$ being greater than, preferably substantially greater than, the running speed of the drying wire 23**.

As is well understood, a moving wire such as drying wire 23 carries air along with it. If the area from which the drying wire 23 carries the air can be sealed, a negative pressure is produced in that particular zone. In the present invention, the sealing of such an area 27 adjacent the running wire 23 (see FIG. 2) is performed by blowing of gas, such as air jets $S_1$ noted above. Since the speed of the jets $S_1$ is greater than these running speed of the wire 23, an air ejection effect is produced, which intensifies the negative pressure produced in the zone 27 by the wire 23 carrying air out of this zone 27 along with it. Sealing of this area or zone 27 of negative pressure in the other direction, takes place by way of gas or air jets $S_2$ being directed in the fashion illustrated in FIG. 2. The direction of these jets $S_2$ is substantially parallel to an imaginary tangent at the surface of fetching roll 22, and may also be substantially perpendicular to the direction of jets $S_1$ as illustrated in FIG. 2.

Due to the effect of the zone 27 of negative pressure produced in the distance Δ between the blow boxes **25*a*, 25*b*, and 25*c* and the drying wire 23, air tends to flow through the wire 23. Since the web $W_2$ is practically impervious to air, the web $W_2$ is urged into tight contact with the drying wire 23, so that no detrimental fluttering of the web W occurs along this run $W_2$. Under these circumstances, the blowing boxes 25*a*, 25*b*, and 25*c* stabilize the running of the wire 23 and of the web $W_2$ between the fetching roll 22 and the first cylinder 20** of the drying section.

Figure 2:
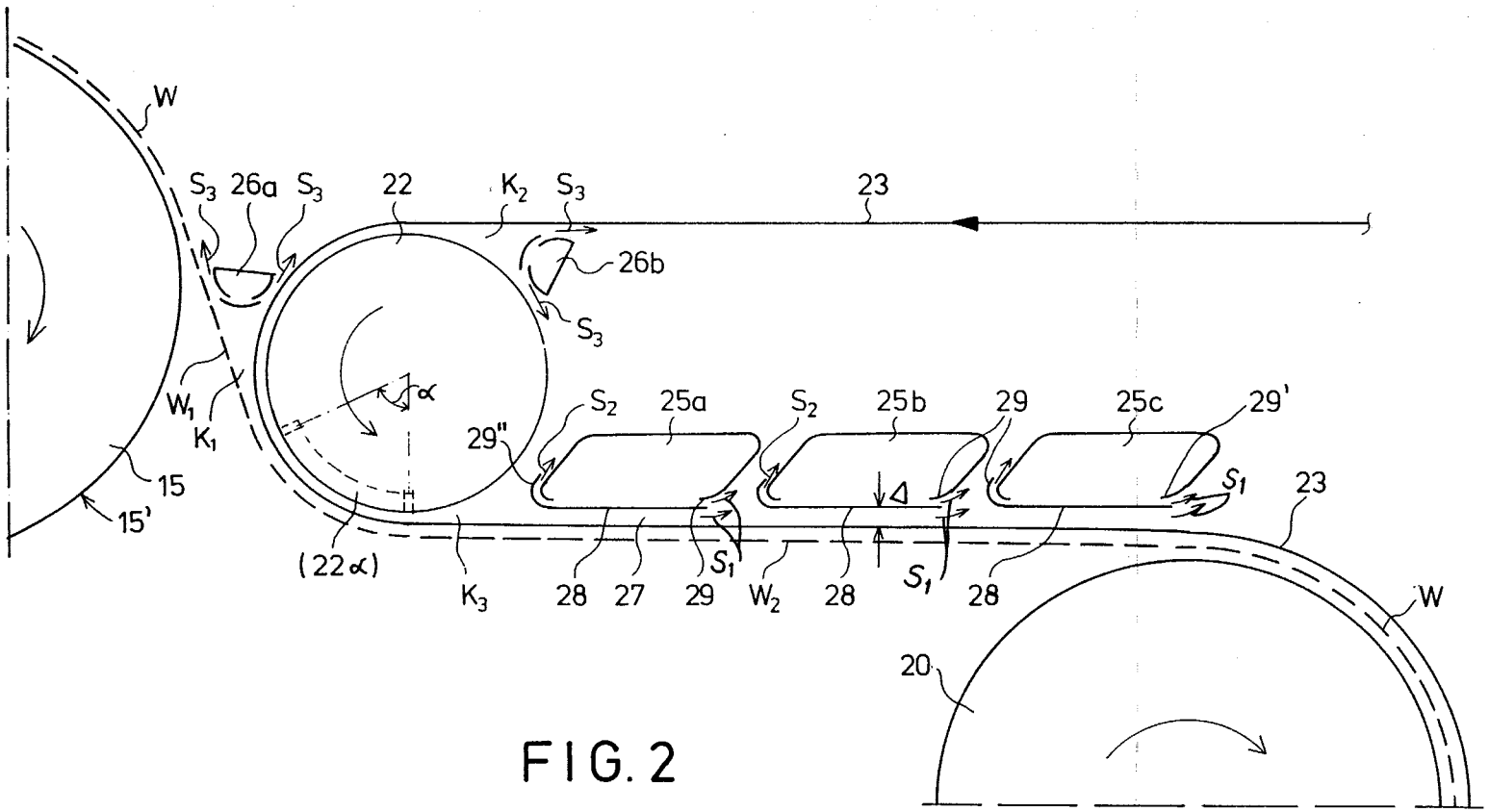
FIG. 2 is a schematic illustration illustrating a section of a paper machine between the press section and the drying section, in which the apparatus and method of the present invention are utilized for supporting and guiding the running web (the scale in FIG. 2 is larger than the scale of FIG. 1).

As illustrated in FIG. 2, three blowing boxes **25*a*, 25*b*, and 25*c* are disposed one after the other. One or several such blowing boxes may be utilized, depending on the requisite dimensions between a press section and a drying section. The individual blowing boxes 25*a*, 25*b* and 25*c* have a planar bottom face 28 which is disposed at the distance Δ opposite the drying wire 23, forming zone 27 in which negative pressure is generated. Distance Δ is preferably in the range of about 10 to 25 mm. Nozzle slots 29 are disposed at both ends of the planar bottom wall 28 of each of the blowing boxes 25*a*, 25*b*, 25*c* as illustrated in FIG. 2. Gas or air jets $S_1$ and $S_2$ as described above, are generated in the respective blow boxes and through the respective nozzle slots 29. The last nozzle slot 29' of the last blowing box 25*c* disposed in the running direction of the drying wire 23, is located substantially at the position at which the drying wire 23 and the web W reach contact with the first drying cylinder 20 of the drying section, as illustrated in FIG. 2**.

The fetching roll 22 may also be disposed as a suction roll, with the suction zone 22α being illustrated with broken lines in FIG. 2. While such a suction zone 22α is not a mandatory requirement in a fetching roll 22, the suction zone 22α does guarantee that the web W remains in contact with the drying wire 23 as the wire 23 changes direction over the sector α of the fetching roll 22. It is also possible in accordance with the present invention, to use a grooved roll instead of the suction roll 22. In such a grooved roll, a slight negative pressure is formed in the grooves therein, within an area corresponding to the suction zone 22α of the suction roll.

As illustrated in the particular embodiment of the present invention shown in FIG. 2, fetching roll 22 can be disposed to form three chutes or troughs $K_1$, $K_2$, and $K_3$, with a respective drying wire 23 and/or running web W. Chute or trough $K_1$ is formed between the free or open draw of the web $W_1$ and the drying wire 23 passing about fetching roll 22, chute or trough $K_2$ is formed between an incoming run of drying wire 23 and the fetching roll 22, and chute or trough $K_3$ is formed between the fetching roll 22 and an outgoing run of the drying wire 23 supporting web $W_2$, as illustrated in FIG. 2. Any tendency to generate a positive pressure in chutes or troughs $K_1$ and $K_2$ (i.e. to inspire air into the respective chutes or troughs $K_1$ and $K_2$ due to the incoming drying wire 23 and/or web W which would tend to detach drying wire 23 from fetching roll 22 and/or detach web W from drying wire 23), can be effectively prevented by the apparatus and method disclosed in U.S. patent application Ser. No. 328,793 filed Dec. 8, 1981, which discloses situation of blowing boxes **26*a* and 26*b* as illustrated in FIG. 2, for the purpose of directing air jets $S_3$ against the direction of movement of the drying wire 23 and/or web W, and/or fetching roll 22. Thus, the ejection of air from these respective chutes or troughs $K_1$ and $K_2$ by the air or gas jets $S_3$ emanating from respective blowing boxes 26a and 26b**, prevents generation of any detrimental positive pressure in these chutes or troughs $K_1$ and $K_2$.

Additionally, the first blowing box 25a of the present invention, situated in the running direction of the drying wire 23 and web $W_2$ as illustrated in FIG. 2, may be disposed in fairly close proximity to fetching roll 22 and chute or trough $K_3$ formed therein, so that gas or air $S_2$ blown through the very first slot 29'' disposed in this blowing box 25a in the running direction of the drying wire 23 also acts to eject air out of the chute or trough $K_3$ at the outlet side of the fetching roll 22 and the outgoing run of the drying wire 23, to prevent any generation of detrimental positive pressure within this particular chute or trough $K_3$. Thus a further feature within the context of the present invention is the combination of the blowing boxes 26a and 26b as disclosed in U.S. patent application Ser. No. 328,793 together with the disposal of the first blowing box 25a as noted above, to minimize and prevent any generation of detrimental positive pressure within any chutes or troughs $K_1$, $K_2$, and $K_3$ disposed around the fetching roll 22, which would tend to detach the drying wire 23 from the fetching roll 22 and/or detach the running web W from the drying wire 23.

Detaching of the web W from the smooth face 15' of the stone roll 15 may also be performed by means of a further suction roll, in addition to fetching roll 22, in accordance with the present invention. The apparatus and method of the present invention are also suitable for supporting the run of the web W from the press section to the drying section, when such an additional suction roll is used to detach the running web from the smooth surface 15' of the stone roll 15.

The above description of the present invention is merely exemplary, and is not intended to limit the scope thereof in any way.

What is claimed is:

1. Apparatus for guiding a fibrous web from a press section to a drying section, comprising a guide roll adapted to guide the web passing from the press section onto a drying wire from the drying section passing about said guide roll, and means for urging the web and drying wire against one another as the web is passed to the drying section, said urging means disposed between said guide roll and the drying section in a running direction of the web and wire, said guide roll constituting means for passing the web in an open draw from the press section onto the drying wire, and said urging means comprising means for generating a negative pressure in a space adjacent a side of the drying wire opposite a side contacting the web, to urge the web and drying wire against each other, and said negative pressure generating means comprising at least one blowing box having gas discharge means extending substantially over an entire width of the web, said blowing box directing a gas stream through said gas discharge means in a direction substantially parallel to the running direction of the web and supporting drying wire, and at a speed greater than a running speed of the drying wire, to create negative pressure between the blowing box and the drying wire to thereby urge the web and drying wire against one another.

2. The apparatus of claim 1, in which said guide roll is a suction roll having a suction zone over which the drying wire passes.

3. The apparatus of claim 1, wherein said gas discharge means are constituted by at least one nozzle slot or apertures.

4. The apparatus of claim 3, in which said negative pressure generating means comprises a plurality of blowing boxes, each box provided with a respective nozzle slot and a side facing the drying wire and extending substantially parallel to the running direction of the drying wire between said guide roll and the drying section.

5. The apparatus of claim 4, in which said negative pressure generating means comprises three blowing boxes successively disposed in the running direction of the drying wire and web, with the sides facing the drying wire being disposed in substantially the same plane.

6. The apparatus of claim 4, in which each of said blowing boxes comprises an additional nozzle slot, said additional nozzle slots extending over substantially the entire width of the web and constituting means for enhancing negative pressure generation between said blowing boxes and the drying wire.

7. The apparatus of claim 6, in which one of said blowing boxes is disposed in a vicinity of said guide roll and constitutes means for ejecting air out of a chute formed between said guide roll and the drying wire.

8. The apparatus of claim 6, in which one of said blowing boxes is disposed adjacent a drying cylinder in the drying section.

9. The apparatus of claim 5, in which the sides of said blowing boxes facing the drying wire are disposed at a distance of about 10 to 25 mm from the drying wire.

10. The apparatus of claim 1, in which said guide roll constitutes means for extending the web from about 1 to 1.5% in the running direction thereof, as the web passes in the open draw from the press section onto the drying wire.

11. The apparatus of claim 7, additionally comprising means for ejecting air from a second chute formed between said guide roll and the drying wire, and from a third chute formed between the web and drying wire passing around said guide roll.

12. The apparatus of claim 11, in which said means for ejecting air out of the second and third chutes, comprises a blowing box disposed in the second chute and directing a gas stream in a direction substantially opposite to the running direction of the drying wire, and a blowing box disposed in the third chute and directing a gas stream in a direction substantially opposite to the running direction of the web.

13. A method for guiding a fibrous web from a press section to a drying section, comprising the steps of passing the web from the press section in an open draw onto a drying wire passing about a guide roll, and urging the web and drying wire against each other as the drying wire passes from the guide roll to the drying section by ejecting gas out of blowing means on a side of the drying wire opposite a side supporting the web in a direction substantially parallel to a running direction of the drying wire and web and at a speed greater than a running speed of the drying wire in order to generate negative pressure in a space between the blowing means and the drying wire.

14. The method of claim 13, which additionally comprises suctioning the web onto the drying wire passing about the guide roll.

15. The method of claim 13, additionally comprising blowing gas in a direction substantially parallel to a tangent of the guide roll, to enhance generation of negative pressure in the space on the side of the drying wire opposite the side supporting the web.

16. The method of claim 15 comprising the additional step of blowing air out of a chute formed between the guide roll and the drying wire.

17. The method of claim 16 comprising the additional steps of blowing air out of a second chute formed between the guide roll and the drying wire, and out of a third chute formed between the web and the drying wire passing around the guide roll.

18. The method of claim 14, comprising stretching the web from about 1 to 1.5% in the running direction thereof as the web is passed in the open draw from the press section onto the drying wire passing about the guide roll.

* * * * *